US005276275A

United States Patent [19]

Suzuki et al.

[11] Patent Number: 5,276,275

[45] Date of Patent: Jan. 4, 1994

[54] TONE SIGNAL PROCESSING DEVICE HAVING DIGITAL FILTER CHARACTERISTIC CONTROLLABLE BY INTERPOLATION

[75] Inventors: Hideo Suzuki; Tsutomu Yanase, both of Hamamatsu, Japan

[73] Assignee: Yamaha Corporation, Hamamatsu, Japan

[21] Appl. No.: 842,065

[22] Filed: Feb. 26, 1992

[30] Foreign Application Priority Data

Mar. 1, 1991 [JP] Japan ..... 3-059362

[51] Int. Cl.[5] ..... G10H 1/12

[52] U.S. Cl. ..... 84/661; 84/DIG. 9

[58] Field of Search ..... 84/607, 608, 622-

[56] References Cited

U.S. PATENT DOCUMENTS 4,738,179 4/1988 Suzuki .

4,907,484 3/1990 Suzuki et al. .

5,173,567 12/1992 Fujita ..... 84/607

*Primary Examiner*—Stanley J. Witkowski

*Attorney, Agent, or Firm*—Graham & James

[57] ABSTRACT

Timewise change of filter characteristics is realized by interpolating filter coefficients to be applied to a digital filter circuit with a function of time. Scaling parameters are generated in correspondence to the tone pitch of a tone signal applied to the digital filter circuit and a time function in the interpolation operation is variably controlled in accordance with the scaling parameters. The inclination of timewise change of filter coefficients obtained by the interpolation is thereby variably controlled and, as a result, the rate of change of the filter coefficients, i.e., the rate of timewise change of filter characteristics realized thereby, is variably controlled in accordance with tone color.

8 Claims, 4 Drawing Sheets

TONE SIGNAL PROCESSING DEVICE HAVING DIGITAL FILTER CHARACTERISTIC CONTROLLABLE BY INTERPOLATION

BACKGROUND OF THE INVENTION

This invention relates to a tone signal processing device employing a digital filter used in an electronic musical instrument and, more particularly, to a tone signal processing device of a type which realizes timewise change of filter characteristics by preparing timewise changing filter coefficients by an interpolation operation capable of variably controlling the rate of change in accordance with tone color of a tone.

An electronic musical instrument realizing timewise change of a tone color by timewise changing filter coefficients of a digital filter provided for controlling a tone signal is disclosed in U.S. Pat. No. 4,738,179. In this electronic musical instrument, filter coefficients are stored in a memory in correspondence to a predetermined time frame and, at each time frame, a corresponding filter coefficient is read from the memory and supplied to a digital filter. Thus, filter characteristics are changed frame by frame by changing filter coefficients frame by frame. In conventional electronic musical instruments, for variably controlling filter characteristics for a tone color control in accordance with key touch or key scaling (variable control corresponding to tone pitch), filter coefficients had to be prestored in a memory for each realizable filter characteristics.

U.S. Pat. No. 4,907,484 discloses a device in which a larger number of filter coefficients than filter coefficients stored in a memory are generated by an interpolation operation on the basis of filter coefficients read from the memory whereby filter characteristics having abundant variation can be realized without increasing the amount of filter coefficients stored in the memory. This device performs a tone color control corresponding to key scaling but this is key scaling of a static tone color and not key scaling of dynamic change of tone color, i.e., the rate of timewise change of tone color. When, for example, an interpolation operation is performed on the basis of a first filter coefficient and a second filter coefficient, interpolation coefficient is changed with lapse of time during a predetermined time frame and the filter coefficient obtained by this interpolation operation thereby changes with lapse of time from the first filter coefficient to the second filter coefficient. According to the prior art device, the value of the first filter coefficient and the second filter coefficient which are used as the basis of the interpolation operation can be key scale controlled but the rate or time length of timewise change thereof cannot be key scale controlled.

It is known that in a natural musical instrument, not only its steady-state tone color but the rate of timewise change of the tone color change in accordance with its tone pitch. The prior art device is insufficient in that it can key scale control the steady-state tone color but it cannot key scale control the rate of timewise change of the tone color.

SUMMARY OF THE INVENTION

It is, therefore, an object of the invention to provide a tone signal processing device of a type realizing timewise change of filter characteristics by preparing timewise changing filter coefficients by an interpolation operation which is capable of variably controlling the rate of this timewise change in accordance with tone pitch of a tone and thereby reproducing a tone having a characteristic closely resembling a natural music instrument.

A tone signal processing device achieving the above described object of the invention comprises digital filter means receiving a tone signal and filter coefficients for controlling filtering of the tone signal in accordance with characteristics determined by the filter coefficients, filter coefficient supply means for supplying at least two sets of filter coefficients corresponding to different filter characteristics, filter coefficient interpolation means for interpolating the filter coefficients supplied by said filter coefficient supply means with a function of time and supplying timewise changing filter coefficients obtained by the interpolation to said digital filter means, scaling parameter generation means for generating scaling parameter in correspondence to the pitch of the tone signal applied to said digital filter means, and control means for controlling the function of time in said interpolation means by said scaling parameter and thereby controlling the rate of timewise change of filter coefficients obtained by the interpolation.

The filter coefficient interpolation means performs a predetermined interpolation operation on the basis of filter coefficients supplied by the coefficient supply means in accordance with a desired tone color and generates, by the interpolation operation, filter coefficients which change with lapse of time during a period of time the filter coefficients supplied by the coefficient supply means maintain a constant value. The function of time in the interpolation operation is controlled by the scaling parameter corresponding to the tone pitch of a tone signal. Inclination of timewise change of filter coefficients obtained by the interpolation thereby is variably controlled and, as a result, the rate of change of filter coefficients, i.e., the rate of change of filter characteristics realized thereby, is variably controlled.

In the foregoing manner, the rate of timewise change of a tone color can be variably controlled in accordance with tone pitch. Acordingly, a tone having a key scaling characteristic closely resembling a natural musical instrument can be reproduced and, even in a case where simulation of a natural musical instrument is not necessary, a tone color change control rich in variety can be realized.

An embodiment of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
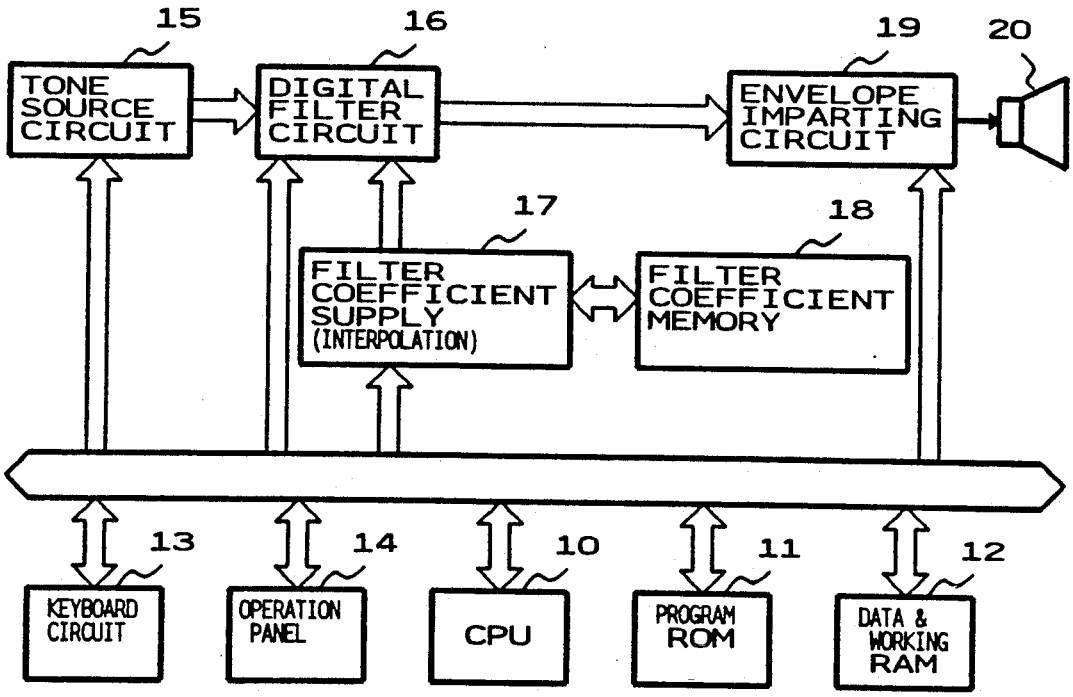
FIG. 1 is a block diagram showing a hardware structure of an embodiment of the invention applied to an electronic musical instrument.

FIG. 1 shows a hardware structure of an embodiment of an electronic musical instrument according to the invention. In this embodiment, timewise change in a filter characteristic is realized by interpolating filter coefficients corresponding to different time frames with lapse of time. In the electronic musical instrument of this embodiment, key switch scanning in a keyboard, tone generation assignment, panel switch scanning and various other processings are controlled by a microcomputer including a CPU (central processing unit) 10, a program ROM (read only memory) 11 and a data and working RAM (random access memory) 12. A keyboard circuit 13 is provided for a keyboard having keys for designating tone pitches of tones to be generated and includes key switches corresponding to the respective keys in the keyboard. An operation panel 14 includes various operators and switches for selecting, setting and controlling tone color, tone volume, tone pitch, effects etc. and displays relating thereto.

A tone source circuit 15 has a plurality of tone generation channels. Generation of a tone corresponding to a key depressed in the keyboard is assigned to one of these channels and a digital tone signal having the tone pitch of the depressed key which has been assigned to each channel of the tone source circuit 15 is generated in that channel. As a tone signal generation system, any type of tone signal generation system such as a waveform memory system, an FM system and an AM system may be employed. The digital tone signal thus generated is applied to a digital filter circuit 16.

The digital filter circuit 16 is made of a digital filter which executes a proper filter operation algorithm such as FIR and IIR. The filter circuit 16 receives filter coefficient data corresponding to a selected tone color etc. supplied from a filter coefficient supply section 17 and data specifying a filter operation algorithm corresponding to the selected tone color etc. The filter coefficient supply section 17 performs operations including a reading control of filter coefficients stored in a filter coefficient memory 18 and an interpolation operation of read out filter coefficients and supplies a finally obtained filter coefficient to the filter circuit 16.

The filter coefficient memory 18 prestores a number of sets of filter coefficients corresponding to plural time frames in correspondence to combinations of tone color determining elements such as a tone color type, tone pitch and key touch. In accordance with tone color determining elements including a tone color selected in the operation panel 14, tone pitch of a key depressed in the keyboard and key touch of the depressed key, a set of filter coefficients corresponding to plural time frames is selected and a filter coefficient corresponding to each time frame is sequentially read from the memory 18 as time elapses during generation of the tone. In accordance with the filter coefficient of each read out frame, the filter coefficient supply section 17 performs an operation for interpolating filter coefficients of adjacent time frames and supplies an interpolation output filter coefficient which is obtained in each interpolation step to the filter circuit 16. This filter coefficient memory 18 may be made of an internal ROM built in the electronic musical instrument or may be made of a detachable memory such as an external ROM or other external storage medium.

In this embodiment, a key scaling parameter corresponding to the tone pitch of each key is stored for each tone color in the filter coefficient memory 18. In other words, a key scaling parameter can be generated with a key scaling characteristic which differs tone color from tone color. This key scaling parameter is read out in accordance with the tone pitch of a depressed key and is utilized for key scaling controlling interpolation time or the number of interpolation steps in the interpolation operation.

The filter circuit 16 receives a filter coefficient provided on the basis of the digital tone signal and the interpolation operation and controls the input tone signal in accordance with a filter characteristic which is established by this filter coefficient. The digital tone signal provided from the filter circuit 16 is imparted with an amplitude envelope by an envelope imparting circuit 19 and is supplied to a sound system 20 after being converted to an analog signal.

Figure 2:
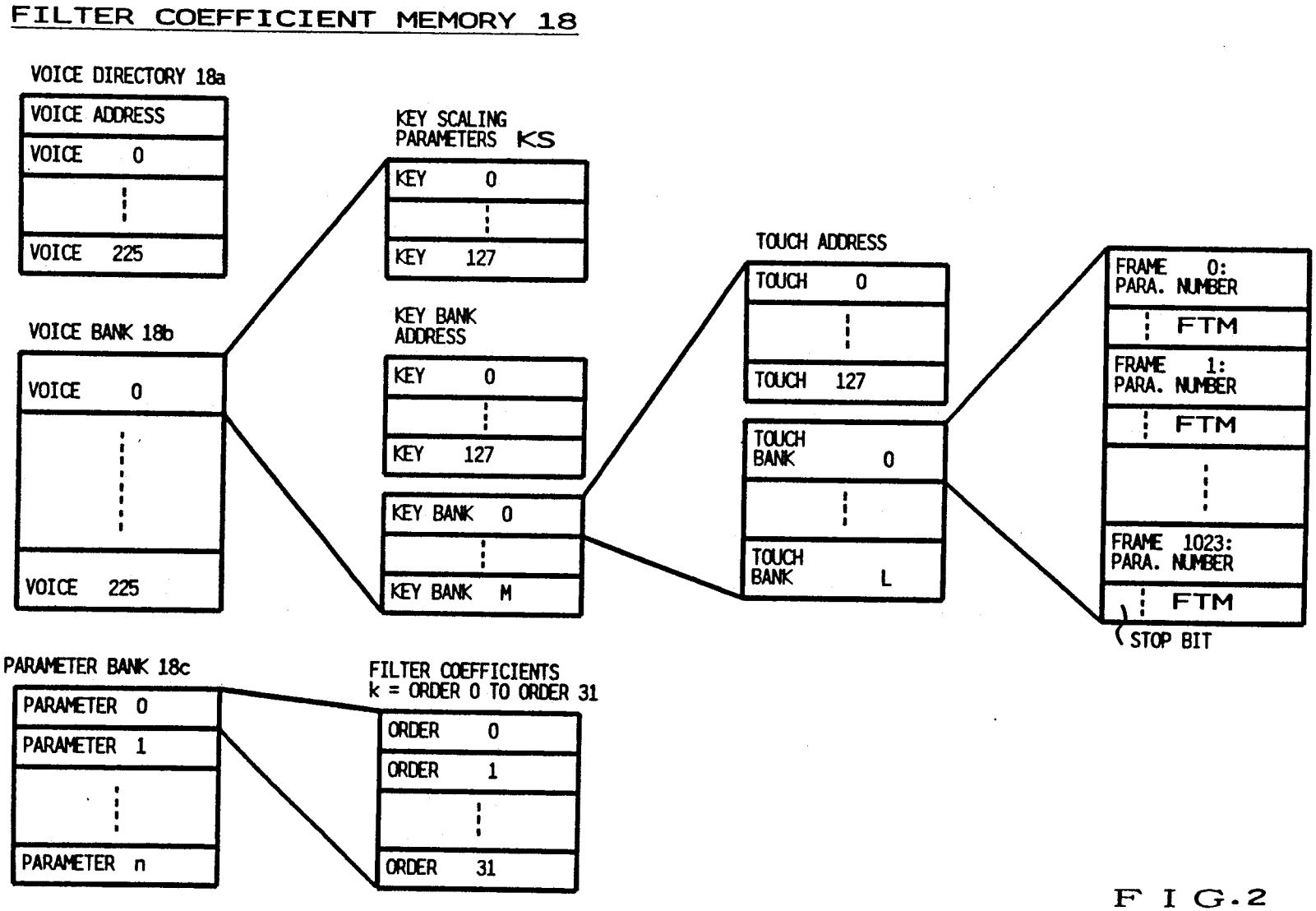
FIG. 2 is a diagram showing an example of memory format of the filter coefficient memory in FIG. 1.

An example of a memory format in the filter coefficient memory 18 is shown in FIG. 2. This filter coefficient memory 18 includes a voice directory **18*a*, a voice bank 18*b* and a parameter bank 18*c*. Filter coefficients per se are stored in the parameter bank 18*c* and in the voice bank 18*b*** are stored address data for reading out filter coefficients which are determined in correspondence to combination of tone color determining elements including tone color, tone pitch and key touch and also stored parameter data for the filter coefficient interpolation operation.

In the voice directory **18*a*, there are stored voice addresses corresponding to plural tone colors (these tone colors are designated by voices 0–225). A voice address corresponding to a selected tone color is read from the voice directory 18*a*. The voice address is data representing a head address of a storage bank corresponding to each of the voices 0–225 in the voice bank 18*b***.

The voice bank **18*b* consists of storage banks (voice banks) corresponding to the respective voices 0–225. Each of the voice banks corresponding to the respective voices (tone colors) includes, as illustrated by way of example with respect to the voice 0, a key scaling parameter memory section storing key scaling parameters KS for respective keys 0–127, a key bank address table storing head addresses of key banks corresponding to the respective keys 0–127 and key banks 0–M corresponding to plural key groups 0–M**.

The key bank includes, as illustrated by way of example with respect to the key bank 0, a touch address table and touch banks corresponding to plural touch groups O–L. The touch address table stores addresses for reading touch banks in correspondence to touches 0–127 of 128 stages. Each touch bank is a memory bank (touch bank) corresponding to each of the touch groups O–L. Each touch bank corresponding to one of the touch groups includes, as illustrated by way of example with respect to the touch bank 0, frame banks corresponding to plural time frames 0–1023. In the example of FIG. 2, the touch banks O–L are provided in correspondence to the respective key banks. Alternatively, one touch bank may be provided commonly for these key banks.

In each frame bank corresponding to one of the frames 0–1023 are stored a parameter numbers for specifying a set of filter coefficients concerning the particular frame and frame time data FTM designating time length of the particular frame. All of the frames 0–1023 need not necessarily be used but a suitable frame may be used as the last frame. For this purpose, the most significant bit of the frame time data FTM is used as a stop bit. This stop bit is normally "0" and becomes "1" in the last frame. In other words, a signal "1" appears as the stop bit in the last frame thereby indicating that this frame is the last frame.

In this embodiment, one step of the interpolation operation, i.e., one interpolation step, is executed in a fixed time (e.g., 1.6 ms). The frame time data FTM indicating the time length of the frame, therefore, represents the number of times of interpolation, i.e., the number of interpolation steps.

The parameter number is address data for reading out a set of filter coefficients corresponding to the particular frame from the parameter bank 18*c*. The parameter bank 18*c* stores plural sets of filter coefficients (these are designated by parameters 0–n). One set of filter coefficients consists, as illustrated by way of example with respect to parameter 0, of 32 filter coefficients from the order 0 to the order 31.

A control for reading the filter coefficients from the filter coefficient memory 18 is performed by the filter coefficient supply section 17 in accordance with a selected tone color and tone pitch and key touch of the depressed key. The outline of this control will be described below. First, reading of one of the voice banks in the voice bank 18*b* is designated by a voice address read from the voice directory 18*a* in accordance with the selected tone color. Then, from the designated voice bank, key scaling parameter KS and key bank address are read out in accordance with the key code of the depressed key. In accordance with the read out key bank address, one of the key banks in the voice bank is designated. In the designated key bank, touch address corresponding to the touch data of the depressed key is read out and one touch bank is designated in accordance with this touch address.

In the designated touch bank, data is read out in the order starting from the frame 0. The respective frames 0–1023 correspond to time sequence. The starting time of tone generation corresponds to the frame 0 and the frame is changed to 1, 2, 3 . . . , sequentially at a suitable time interval as time elapses. Interpolation operation of a filter coefficient is performed for each frame. More specifically, during the frame 0, a parameter number and frame time data FTM are read from the bank of the frame 0 and also a parameter number is read from the bank of next frame 1. One of the parameters 0–n stored in the parameter bank 18*c* is designated by the parameter number read from the frame bank so that a set of filter coefficients corresponding to the designated parameters are read out. Accordingly, sets of filter coefficients of adjacent two frames (e.g., the frames 0 and 1) are respectively read out.

The filter coefficient supply section 17 executes a predetermined interpolation operation for each order on the basis of the filter coefficients of the adjacent two frames. This interpolation is one which is a function of time. Plural interpolation steps are established in accordance with time corresponding to the read out frame time data FTM and a coefficient of interpolation is changed as the interpolation step advances with lapse of time. By this arrangement, the filter coefficient obtained as a result of the interpolation operation undergoes a smooth timewise change from the filter coefficient of the preceding frame to the filter coefficient of the next frame in the two adjacent frames. Since, as described above, time of one interpolation step is fixed, the read out frame time data FTM is data corresponding to the number of the interpolation steps. This frame time data FTM determines a reference interpolation step number when the key scaling control is not performed. The reference interpolation step number determined by the frame time data FTM is increased or decreased by the key scaling parameter KS read out in accordance with the depressed key. This is equivalent to addition or substraction of the interpolation time. As a result of this key scaling control, time during which the filter coefficient changes from the filter coefficient of the preceding frame to the filter coefficient of the next frame is variably controlled, i.e., the speed of change is variably controlled.

Figure 3:
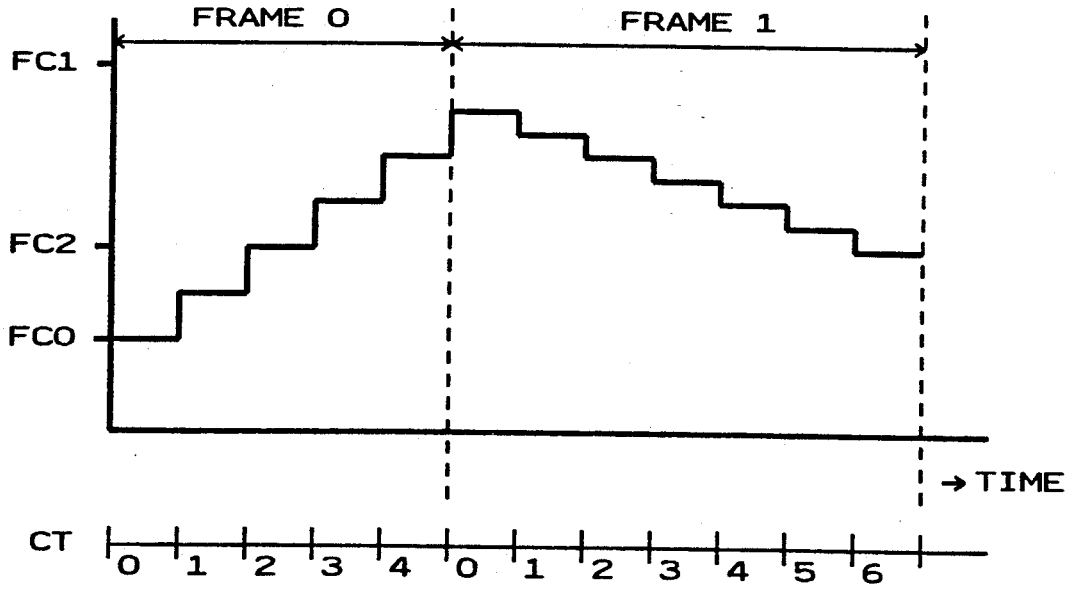
FIG. 3 is a diagram showing an example of interpolation operation for filter coefficients performed by the same embodiment.

FIG. 3 shows an example of the above described interpolation processing. In this example, the frame time data FTM in the frame 0 is 5 and the interpolation is made with five interpolation steps from filter coefficient FC0 of the frame 0 to filter coefficient FC1 of the frame 1. There is also shown a case where the frame time data FTM in the frame 1 is 7 and the interpolation is made with seven interpolation steps from filter coefficient FC1 of the frame 1 to filter coefficient FC2 of the frame 2. CT represents change in the count of the interpolation step counter controlling the interpolation step.

Description will now be made about an example of a processing executed by the microcomputer.

Figure 4:
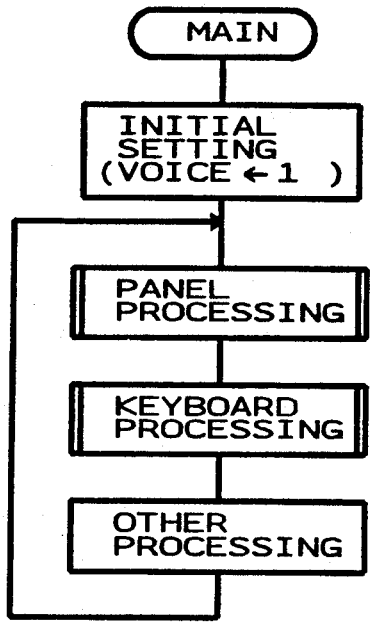
FIG. 4 is a flow chart showing an example of main routine executed by the microcomputer of the same embodiment.

FIG. 4 shows a main routine. After a predetermined initial setting, "panel processing", "keyboard processing" and "other processing" are repeatedly executed. The initial setting includes a processing in which 1 is set in a voice number register VOICE.

Figure 5:
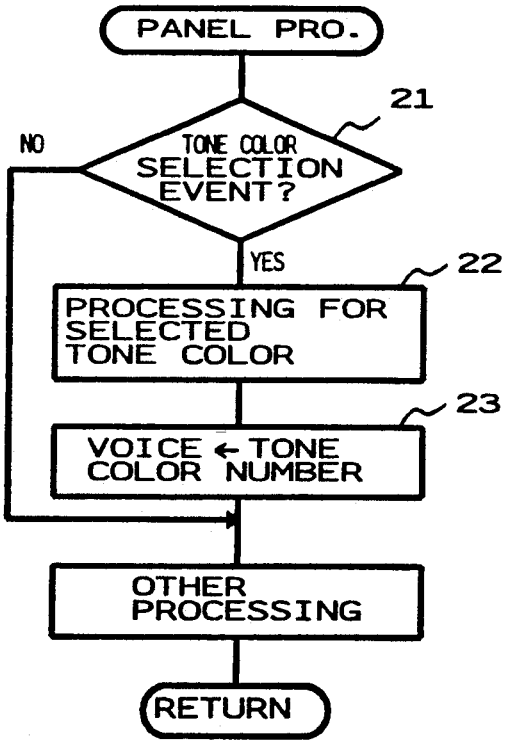
FIG. 5 is a flow chart showing an example of "panel processing" of FIG. 4.

In the "panel processing", the operation panel 14 is scanned and a processing corresponding to the result of the scanning is performed. An example of such processing is shown in FIG. 5. In this example, whether or not a tone color selection event has taken place is examined (step 21). If the result is YES, a proper processing for setting the selected tone color is performed (step 22) and tone color number data of the selected tone color is set in the voice number register VOICE (step 23).

Figure 6:
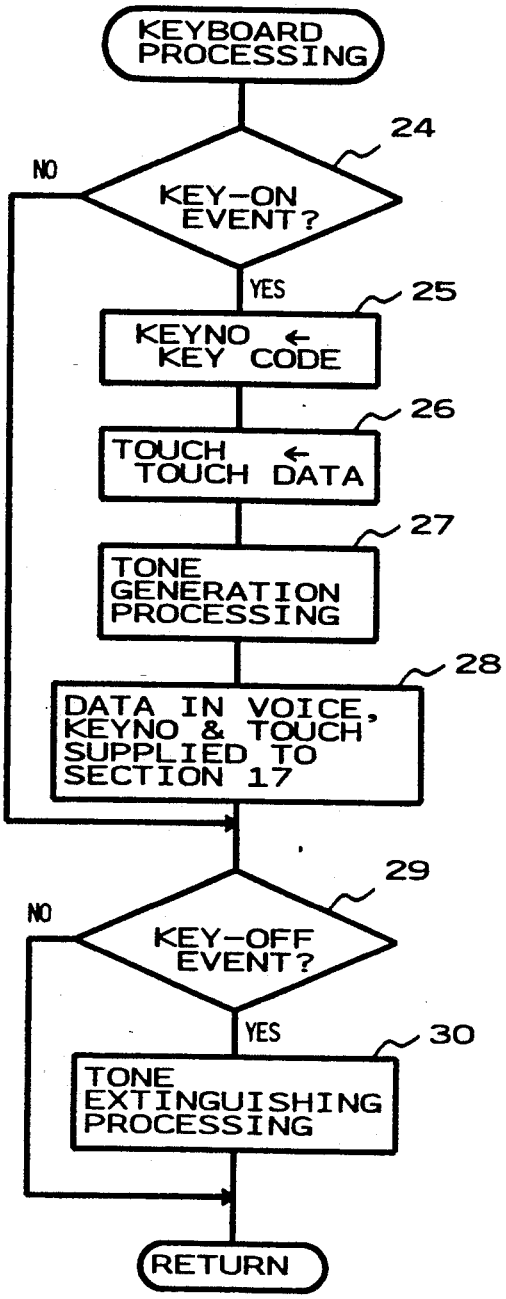
FIG. 6 is a flow chart showing an example of "keyboard processing" of FIG. 4.

In the "keyboard processing", the keyboard circuit 13 is scanned and a processing corresponding to the result of the scanning is performed. An example thereof is shown in FIG. 6. In this example, whether or not a key-on event (i.e., new key depression) has taken place is examined (step 24). If the result is YES, the key code of the key concerning the key-on event is set in a key number register KEYNO (step 25). The touch data of the key concerning the key-on event is set in a touch register TOUCH (step 26). In the tone generation processing of step 27, generation of a tone for the key concerning the key-on event is assigned to any of channels of the tone source circuit 15 and causes the tone source circuit 15 to generate the tone signal of the key. In next step 28, the tone color number data, key code and touch data which are respectively set in the registers VOICE, KEYNO and TOUCH are supplied to the filter coefficient supply section 17. The filter coefficient supply section 17 performs accessing of the filter coefficient memory 18 and the filter coefficient interpolation operation which has been briefly described above. When a key-off event is detected, a processing for extinguishing a tone corresponding to the key-off event is performed.

Figure 7:
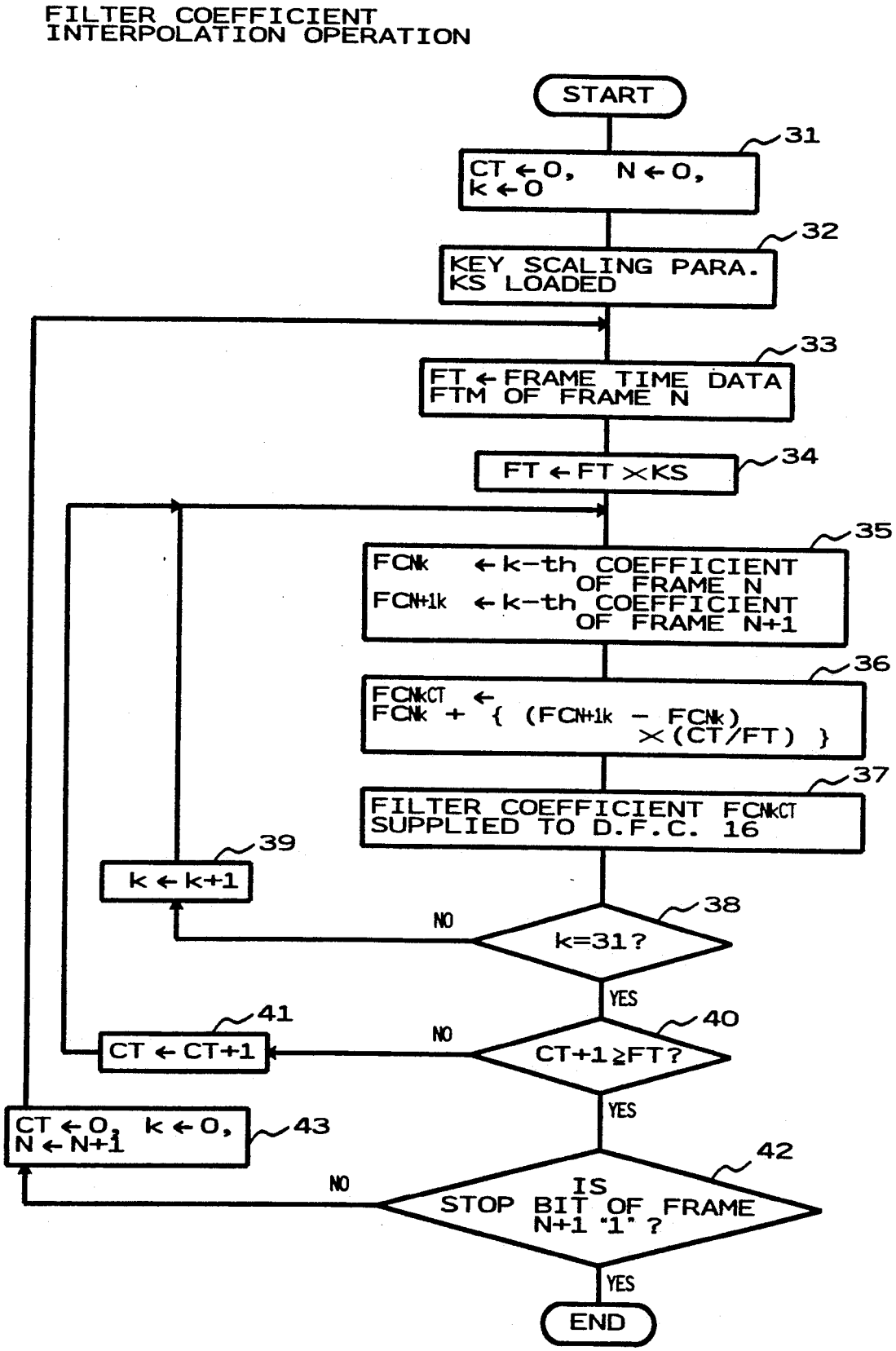
FIG. 7 is a flow chart showing an exmaple of processing including a filter coefficient interpolation operation executed by the filter coefficient supply section in FIG. 1.

By way of an example, the filter coefficient supply section 17 performs the filter coefficient interpolation operation by processing by the microcomputer in accordance with a flow chart shown in FIG. 7. As this microcomputer, the main CPU 10 may be used or an auxiliary CPU may be provided in the filter coefficient supply section 17. In case the main CPU 10 is used, the filter coefficient interpolation operation is performed side by side with the processing shown in FIGS. 4 to 6.

The processing of FIG. 7 is started when the filter coefficient supply section 17 has received the tone color number data, key code and touch data of the respective registers VOICE, KEYNO and TOUCH supplied in step 28. First, the interpolation step counter CT, frame number counter N and order number counter k are reset to an initial value 0 (step 31). Then, accessing of the filter coefficient memory 18 is made in the above described manner in accordance with the tone color number data, key code and touch data of the registers VOICE, KEYNO and TOUCH. In accordance with this reading of filter coefficients, the key scaling parameter KS corresponding to the key code (tone pitch) of the depressed key is loaded in an internal register (step 32) and the frame time data FTM of a frame N (in this case N=0) is loaded in an internal register FT (step 33). Then, the frame time data loaded in the internal register FT is multiplied with the key scaling parameter KS loaded in the internal register FT whereby the time frame data is variably controlled in accordance with the key scaling parameter KS. In this manner, contents of the internal register FT are renewed by the key scale controlled frame time data FT×KS (step 34).

An example of the key scaling characteristic will now be described. Since the speed of timewise change of tone color is higher in a high frequency tone region than in a low frequency tone region, an example of key scaling characteristic in which the key scaling parameter KS becomes larger as the tone pitch becomes lower and becomes smaller as the tone pitch becomes higher is conceivable. For example, a monotonously decreasing key scaling characteristic is conceivable in which the value of the key scaling parameter KS corresponding to a middle key (middle tone pitch) is set to 1, that corresponding to the lowest key (the lowest tone pitch) is set to 10 and that corresponding to the highest key (highest tone pitch) is set to 1/10 so that the value of the key scaling parameter KS gradually decreases as the tone pitch becomes higher. The key scaling characteristic however is not limited to this but the highest value of KS may be made even smaller and the lowest value of KS may be made even larger. The key scaling characteristic may be a monotonously increasing type one in which the value of KS gradually increases as the tone pitch becomes higher. The key scaling characteristic is not limited to the above described monotonously decreasing or increasing characteristic but it may be a curve such as a curve of secondary degree. The key scaling characteristic may even be a curve of any selected characteristic which changes in a complex manner in accordance with tone pitch or tone range. As has been described with reference to FIG. 2, the key scaling parameters KS of the respective keys 0–127 are stored for each voice bank and, accordingly, a unique key scaling characteristic can be established for each tone color (i.e., voice).

Reverting to FIG. 7, in step 35, parameter numbers of the frames N and N+1 are respectively read from one touch bank designated by the tone color number data, key code and touch data of the registers VOICE, KEYNO and TOUCH and a filter coefficients of k-th order for each frames N and N+1 is read from the parameter bank 18*c*. The filter coefficient of k-th order of the frame N (designated by FCNk) and filter coefficient of k-th order of the frame N+1 (designated by FCN+1k) thus read out are respectively stored in a register. In next step 36, a predetermined interpolation operation is performed on the basis of the read out filter coefficients FCNk and FCN+1k of the two adjacent frames. First, by dividing the number of interpolation steps which is being counted by the interpolation step counter CT by the frame time data FT (this data has already been key scaled as previously described), interpolation coefficient CT/FT in this interpolation step is obtained. Difference between the filter coefficients FCNk and FCN+1k is multiplied with this interpolation coefficient CT/FT and the product is added to the preceding filter coefficient FCNk. By performing this interpolation operation, a filter coefficient expressed by the formula FCNk+{(FCN+1k−FCNk)×CT/FT} is obtained. The filter coefficient (designated by FCNkCT) obtained by the interpolation operation in the foregoing manner is stored in the internal register. In step 37, the filter coefficient FCNkCT stored in the internal register is supplied to the difital filter circuit 16.

Then, in step 38, whether or not k=31 is examined. If the result is NO, the routine proceeds to step 39 where the value of k is increased by 1. Then the routine returns to step 35 and an interpolation operation which is the same as the one described above is performed. The processing of steps 35, 36, 37, 38 and 39 is repeated and, when the interpolation operation has been completed with respect to all orders, k becomes 31 and the routine proceeds to step 40.

In step 40, whether a value obtained by adding 1 to the current value of the interpolation step counter CT coincides with the frame time data FT or exceeds the frame time data FT is examined. Since CT is initially 0, step 40 is NO and the routine proceeds to step 41 where the interpolation step counter CT is counted up by 1. Then the routine returns to step 35 and an interpolation operation which is the same as the previously described one is performed with respect to CT which has increased by 1. In other words, the interpolation operation is performed after the interpolation step is advanced by 1 to increase the value of the interpolation coefficient CT/FT. Upon reaching the last interpolation step by repeating steps 35, 36, 37, 38, 39, 40 and 41, the value of CT comes nearest to the value of FT in this last interpolation step. In other words, the last interpolation step is an interpolation step in which CT+1 coincides with or becomes larger than FT. At this time, "CT+1≧ FT ?" in step 40 is judged YES and the routine proceeds to step 42. In this embodiment, time for one interpolation step is fixed to a predetermined time interval (e.g., 1.6 ms) and, accordingly, the counting up by 1 in step 41 is made upon arrival of the predetermined time interval (1.6 ms) of one interpolation step.

In step 42, the value of the stop bit positioned at the most significant bit of the frame time data FTM concerning next frame N+1 is accessed and whether this value is "1" or not is examined. When the frame is not the last frame, the stop bit is "0" and the routine proceeds to step 43. In step 43, the interpolation step counter CT is reset to 0 and the frame number counter N is increased by 1 to designate next frame and the order number counter k is reset to 0. The frame is thereby changed. The processing in step 43 is made, in the same manner as described above with respect to step 41, upon arrival of the predetermined time interval (1.6 ms) for one interpolation step. Then, the routine proceeds to step 33 where the frame time data FT about the new frame N is loaded. This frame time data FT is key scale controlled by the key scaling parameter KS in step 34. Thereafter, the processing of steps 35–41 is repeated to perform the coefficient interpolation operation about the new frame N. Upon completion of the processing for all frames, step 42 becomes YES and the processing is ended.

In the above described embodiment, the memory section storing the key scaling parameters KS for the respective keys is provided in the filter coefficient memory 18. The manner of storing the key scaling parameters KS is not limited to this but the key scaling parameters KS for the respective keys may be stored in an independent key scaling parameter memory. In this case, reading of the key scaling parameters KS corresponding to depressed keys may be made during the keyboard processing in FIG. 6. For example, a modification may be made so that there will be inserted between steps 27 and 28 an additional step for reading the key scaling parameter KS from the key scaling parameter memory in accordance with the key code of the depressed key stored in the key number register KEYNO and supplying the read out key scaling parameter KS. Together with this modification, the processing of step 32 in FIG. 2 may be omitted.

An arrangement may also be made so that either the key scaling parameter KS stored in the filter coefficient memory 18 or the key scaling parameter KS stored in an independent key scaling parameter memory will be selectively used.

In the above described embodiment, the type of the scaling characteristic of the key scaling parameter KS to be stored in the memory is one for each tone color (voice). Alternatively, there may be provided plural types of scaling characteristics for each tone color and the player may select a desired one among them. Alternatively further, plural types of key scaling characteristic tables may be provided irrespective of the tone color (voice) and the player may select a desired one among them.

The key scaling parameter memory or table may be a ROM or, alternatively, it may be a RAM and the player may change contents thereof as desired.

The processing of the interpolation operation in the filter coefficient supply section 17 may be realized not only by the software processing as in the above described embodiment but also by a hardware circuit.

In the above described embodiment, the processing time for one interpolation step is fixed and the entire time for interpolation is variably controlled by the key scaling control. Alternatively, the number of the interpolation step may be fixed and the entire time for interpolation may be variably controlled by variably controlling the processing time for one interpolation step by the key scaling.

The operation for key scaling is not limited to multiplication as shown in step 34 in FIG. 7 but may be division or addition or subtraction. In other words, expression of the key scaling parameter is not limited to a coefficient value but may be a difference value or an incremental value or even a decibel representation or floating-point representation.

The interpolation function used in the filter coefficient interpolation operation is not limited to a linear interpolation using CT/FT as the interpolation coefficient but may be other suitable function. The interpolation used is not limited to insertion interpolation which interpolates two adjacent frames by using filter coefficients of the two frames but other interpolation systems such as a system according to which a predicting interpolation is made by using an interpolation coefficient which is based on one filter coefficient and has two different inclinations before and after the one filter coefficient.

The key scaling control may be made not only for each individual key (i.e., individual tone pitch) but for each of several key groups (tone ranges).

This invention is applicable not only to a monophonic electronic musical instrument but also to a polyphonic electronic musical instrument. The invention is applicable also to an electronic musical instrument of a type in which plural tone signals are applied to a filter circuit on a time shared basis and are subjected to a filter operation processing on a time shared basis.

As described above, according to the invention, when a timewise changing filter coefficient is obtained by an interpolation operation, the interpolation time or the number of interpolation steps is controlled by a key scaling parameter corresponding to the tone pitch, so that the inclination of timewise change of the filter coefficient is variably controlled by the tone pitch and, as a result, the speed of change in the filter coefficient, i.e., the speed of change in the filter characteristic realized thereby is variably controlled in accordance with the tone pitch. Accordingly, the speed of timewise change in the tone color can be variably controlled in accordance with the tone pitch whereby a tone having a key scaling characteristic which is closer to a natural musical instrument can be reproduced and, even when a tone of a natural musical instrument is not simulated, a tone color change which is rich in variety can be realized.

What is claimed is:

1. A tone signal processing device comprising:

digital filter means receiving a tone signal and filter coefficients for controlling filtering of the tone signal in accordance with characteristics determined by the filter coefficients;

filter coefficient supply means for supplying at least two sets of filter coefficients corresponding to different filter characteristics;

filter coefficient interpolation means for interpolating the filter coefficients supplied by said filter coefficient supply means with a function of time and supplying timewise changing filter coefficients obtained by the interpolation to said digital filter means;

scaling parameter generation means for generating scaling parameter in correspondence to the pitch of the tone signal applied to said digital filter means; and control means for controlling the function of time in said interpolation means by said scaling parameter and thereby controlling the rate of timewise change of filter coefficients obtained by the interpolation in accordance with pitch.

2. A tone signal processing device as defined in claim 1 wherein said control means controls interpolation time in said interpolation means by the scaling parameter.

3. A tone signal processing device as defined in claim 1 wherein said control means controls the number of steps in said interpolation operation by the scaling parameter.

4. A tone signal processing device as defined in claim 1 wherein said filter coefficient supply means supplies said at least two sets of filter coefficients by changing the filter coefficients with lapse of time.

5. A tone signal processing device as defined in claim 1 wherein said filter coefficient supply means supplies said at least two sets of filter coefficients in accordance with a selected tone color.

6. A tone signal processing device as defined in claim 1 wherein said filter coefficient supply means supplies said at least two sets of filter coefficients in accordance with touch data corresponding to a tone signal applied to said digital filter means.

7. A tone signal processing device as defined in claim 1 wherein said filter coefficient supply means comprises memory means storing plural sets of filter coefficients in correspondence to plural tone colors and said at least two sets of filter coefficients are read from said memory means in accordance with a selected tone color.

8. A tone signal processing device as defined in claim 1 wherein said scaling parameter generation means generates said key scaling parameter corresponding to the pitch of the tone signal in accordance with a scaling characteristic corresponding to a selected tone color.

* * * * *